US011290799B2

(12) United States Patent
Berg

(10) Patent No.: US 11,290,799 B2
(45) Date of Patent: Mar. 29, 2022

(54) EARPIECE

(71) Applicant: FREEBIT AS, Oslo (NO)

(72) Inventor: Richard Steenfeldt Berg, Elisenberg (NO)

(73) Assignee: FREEBIT AS, Oslo (NO)

( * ) Notice: Subject to any disclaimer, the term of this patent is extended or adjusted under 35 U.S.C. 154(b) by 0 days.

(21) Appl. No.: 17/011,652

(22) Filed: Sep. 3, 2020

(65) Prior Publication Data

US 2021/0044884 A1 Feb. 11, 2021

Related U.S. Application Data

(60) Continuation of application No. 16/519,943, filed on Jul. 23, 2019, now Pat. No. 10,812,887, which is a (Continued)

(30) Foreign Application Priority Data

Jun. 1, 2007 (NO) ..... 2007 2812

(51) Int. Cl.
*H04R 1/10* (2006.01)
*H04R 5/033* (2006.01)

(52) U.S. Cl.
CPC ..... *H04R 1/1016* (2013.01); *H04R 1/105* (2013.01); *H04R 1/1091* (2013.01); *H04R 5/033* (2013.01);
(Continued)

(58) Field of Classification Search
CPC .... H04R 1/1016; H04R 1/1091; H04R 5/033; H04R 1/105; H04R 2225/025; H04R 2201/107
See application file for complete search history.

(56) References Cited

U.S. PATENT DOCUMENTS 588,099 A 8/1897 Blount et al.
931,768 A 8/1909 Kirkpatrick
(Continued)

FOREIGN PATENT DOCUMENTS

CN 3434167 3/2005
DE 8328154 U1 2/1984
(Continued)

OTHER PUBLICATIONS

Communication of notices of opposition (R. 79(1) EPC) dated Nov. 5, 2020 in European Patent Application No. 15179718.0, 9 pages.
(Continued)

*Primary Examiner* — Oyesola C Ojo
(74) *Attorney, Agent, or Firm* — Xsensus LLP

(57) ABSTRACT

An ear unit for stably fitting in an ear includes a first surface facing inwardly toward the ear, a second, opposite surface facing outwardly from the ear and an outer circumferential surface formed between the first and second surfaces. The outer circumferential surface is shaped as a decremental curve. The distance between the ends of the decremental curve is approximately equal to the distance between a first cavity formed under the tragus of the ear and second cavity covered by the lower node of the antihelix of the ear. The first surface is provided with a curvature that provides a contact surface that substantially conforms to the concha, providing an improved attachment, thereby enabling the ear unit to fit closely against the concha when the ear unit is positioned into the ear.

1 Claim, 2 Drawing Sheets

Related U.S. Application Data division of application No. 16/003,928, filed on Jun. 8, 2018, now abandoned, which is a continuation of application No. 14/633,813, filed on Feb. 27, 2015, now abandoned, which is a continuation of application No. 14/109,565, filed on Dec. 17, 2013, now Pat. No. 8,976,995, which is a continuation of application No. 12/600,795, filed as application No. PCT/NO2008/000190 on May 30, 2008, now Pat. No. 8,630,436.

(52) U.S. Cl.
CPC .. *H04R 2201/107* (2013.01); *H04R 2225/025* (2013.01)

(56) References Cited

U.S. PATENT DOCUMENTS 1,564,474 A 12/1925 Fensky
1,614,987 A 1/1927 Langenbeck et al.
1,668,890 A 5/1928 Curan et al.
1,668,910 A 5/1928 Jones
1,688,910 A 10/1928 Winship
1,753,817 A * 4/1930 Aber ..... H04R 25/652 181/130
1,893,143 A 1/1933 Koch
1,893,474 A 1/1933 Lieber
1,953,437 A 4/1934 Schier
1,969,559 A 8/1934 Kelly
2,248,837 A 7/1941 Walters
2,312,534 A 3/1943 Fiene
2,437,490 A 3/1948 Watson et al.
2,521,414 A 9/1950 Schier
2,545,731 A 3/1951 French
2,595,489 A 5/1952 Rutter et al.
2,763,334 A 9/1956 Starkey
2,908,343 A 10/1959 Hummert
3,053,061 A 9/1962 French
3,157,245 A 11/1964 Bernstein
3,169,523 A 2/1965 French
3,170,046 A 2/1965 Leale
3,440,365 A 4/1969 Bryant et al.
D221,442 S 8/1971 Feingold
4,010,820 A 3/1977 Johnson
4,055,233 A 10/1977 Huntress
4,091,067 A 5/1978 Kramer et al.
4,219,018 A 8/1980 Draper, Jr.
D266,590 S 10/1982 Bennett
4,353,364 A 10/1982 Woods
4,429,194 A 1/1984 Kamon et al.
D274,814 S 7/1984 Tang
4,540,063 A 9/1985 Ochi et al.
4,646,872 A 3/1987 Kamon et al.
4,720,857 A 1/1988 Burris et al.
4,864,375 A 9/1989 Stevens
4,896,679 A 1/1990 St. Pierre
D316,550 S 4/1991 Sogabe
D318,670 S 7/1991 Taniguchi
5,048,090 A 9/1991 Geers
5,048,092 A 9/1991 Yamagishi et al.
5,055,233 A 10/1991 Borland et al.
D326,655 S 6/1992 Iribe
5,131,411 A 7/1992 Casali et al.
5,222,151 A 6/1993 Nagayoshi et al.
5,247,946 A 9/1993 Holder
5,260,997 A 11/1993 Gattey et al.
5,298,692 A 3/1994 Ikeda et al.
5,333,622 A 8/1994 Casali et al.
D357,921 S 5/1995 Ming-Chin
5,450,496 A 9/1995 Burris et al.
5,544,253 A 8/1996 Nagayoshi et al.
5,548,643 A 8/1996 Dalgleish et al.
5,625,171 A 4/1997 Marshall
5,654,530 A 8/1997 Sauer et al.
5,659,156 A 8/1997 Mauney et al.
5,664,014 A 9/1997 Yamaguchi et al.
5,668,354 A 9/1997 Falco
D384,958 S 10/1997 Shudo
D388,093 S 12/1997 Frengley
5,712,453 A * 1/1998 Bungardt ..... H04R 1/105 181/135
5,727,566 A 3/1998 Leight
5,771,438 A 6/1998 Palermo et al.
5,799,097 A 8/1998 Lo
5,809,159 A 9/1998 Lee
5,912,925 A 6/1999 Palermo et al.
5,943,627 A 8/1999 Kim et al.
5,953,435 A 9/1999 Mullin et al.
5,957,136 A 9/1999 Magidson et al.
6,021,207 A 2/2000 Puthuff et al.
D430,139 S 8/2000 Peters et al.
D430,547 S 9/2000 Yoon
D430,860 S 9/2000 Yoon
6,122,388 A 9/2000 Feldman
6,129,175 A 10/2000 Tutor et al.
6,241,041 B1 6/2001 Leight
6,449,374 B1 9/2002 Skulley et al.
D469,755 S 2/2003 Hlas et al.
D470,122 S 2/2003 Hlas et al.
D470,123 S 2/2003 Hlas et al.
D470,128 S 2/2003 Hlas et al.
D470,129 S 2/2003 Hlas et al.
D471,537 S 3/2003 Ham
D471,890 S 3/2003 Clarkson
D473,204 S 4/2003 Tanio
D478,991 S 8/2003 Dyer et al.
6,625,293 B1 9/2003 Nageno et al.
6,688,421 B2 * 2/2004 Dyer ..... H04R 1/1016 181/130
6,690,807 B1 2/2004 Meyer
6,795,718 B2 9/2004 Bae
6,819,762 B2 11/2004 Jones et al.
6,820,717 B2 11/2004 Fleming et al.
6,868,284 B2 3/2005 Bae
6,879,697 B2 4/2005 Topholm
D505,132 S 5/2005 Linville et al.
6,944,287 B2 9/2005 Mori
6,944,307 B2 9/2005 Berg
D510,574 S 10/2005 Okada
6,961,440 B1 11/2005 Schlaegel
7,050,599 B2 5/2006 Baskerville
7,068,803 B2 6/2006 Kuhlmann et al.
D525,962 S 8/2006 Elson
7,092,543 B1 8/2006 Mahoney et al.
D538,271 S 3/2007 Kim et al.
7,233,676 B2 6/2007 Bayer
D558,735 S 1/2008 Carr et al.
7,340,075 B2 3/2008 Bayer
D566,099 S 4/2008 Komiyama
D566,691 S 4/2008 Andre et al.
D568,302 S 5/2008 Oh
D569,841 S 5/2008 Chung et al.
7,394,910 B2 * 7/2008 Smith ..... H04R 1/1016 381/322
D575,277 S 8/2008 Gaarde et al.
D575,772 S 8/2008 Schultz et al.
7,412,068 B2 8/2008 Bayer
D578,507 S 10/2008 Ando
D578,508 S 10/2008 Wang
D579,006 S 10/2008 Kim et al.
D582,389 S 12/2008 Bose et al.
D582,397 S 12/2008 Christopher
D582,398 S 12/2008 Nam et al.
D582,889 S 12/2008 Bose et al.
D584,284 S 1/2009 Carr et al.
D584,294 S 1/2009 Nam et al.
D585,881 S 2/2009 Nam et al.
D588,099 S 3/2009 Yuyama
D589,945 S 4/2009 Esses
7,536,008 B2 5/2009 Howes et al.
D596,164 S 7/2009 Henning
D601,134 S 9/2009 Elabidi et al.
D602,476 S 10/2009 Lee et al.

(56) References Cited

U.S. PATENT DOCUMENTS

| | | | |
|---|---|---|---|
| D605,170 | S | 12/2009 | Keinanen |
| D605,628 | S | 12/2009 | Ando |
| D607,875 | S | 1/2010 | Pedersen, II |
| D618,219 | S | 6/2010 | Burgett et al. |
| D618,221 | S | 6/2010 | Fahrendorff et al. |
| D620,927 | S | 8/2010 | Li |
| D621,817 | S | 8/2010 | Brickstad |
| D622,265 | S | 8/2010 | Rye |
| D622,704 | S | 8/2010 | Fahrendorff et al. |
| 7,778,410 | B2 | 8/2010 | Liu et al. |
| 7,778,435 | B2 | 8/2010 | Smith et al. |
| 7,822,219 | B2 | 10/2010 | Baker et al. |
| D628,188 | S | 11/2010 | Koch |
| D633,481 | S | 3/2011 | Chen |
| D634,305 | S | 3/2011 | Hoggarth |
| 7,949,127 | B2 | 5/2011 | Pedersen et al. |
| D640,670 | S | 6/2011 | Rye |
| 7,965,855 | B1 | 6/2011 | Ham |
| D641,747 | S | 7/2011 | Gisborne |
| D645,458 | S | 9/2011 | Silvestri et al. |
| 8,251,925 | B2 | 8/2012 | Keady et al. |
| 8,538,056 | B2 | 9/2013 | Ishibashi et al. |
| 8,550,206 | B2 | 10/2013 | Keady et al. |
| 8,630,436 | B2 | 1/2014 | Berg |
| 8,657,064 | B2 | 2/2014 | Staab et al. |
| 8,897,480 | B2 | 11/2014 | Tan et al. |
| 8,976,995 | B2 | 3/2015 | Berg |
| 9,161,114 | B2 | 10/2015 | Bone et al. |
| 9,161,118 | B2 | 10/2015 | Howes et al. |
| D754,638 | S | 4/2016 | Krissman |
| 9,398,365 | B2 | 7/2016 | Liu et al. |
| 10,003,878 | B2 | 6/2018 | Ushakov |
| 2001/0033664 | A1 | 10/2001 | Poux et al. |
| 2002/0096391 | A1 | 7/2002 | Smith et al. |
| 2002/0131585 | A1 | 9/2002 | Jones et al. |
| 2002/0172386 | A1 | 11/2002 | Bayer |
| 2003/0091210 | A1 | 5/2003 | Baskerville |
| 2003/0174853 | A1 | 9/2003 | Howes et al. |
| 2003/0196850 | A1 | 10/2003 | Dryer et al. |
| 2004/0045558 | A1 | 3/2004 | Taylor et al. |
| 2004/0052389 | A1* | 3/2004 | Berg ..... H04M 1/6066 381/315 |
| 2004/0163653 | A1 | 8/2004 | Fleming |
| 2004/0165743 | A1 | 8/2004 | Bayer |
| 2005/0008180 | A1 | 1/2005 | Smith et al. |
| 2006/0067524 | A1 | 3/2006 | Smith |
| 2006/0067556 | A1* | 3/2006 | Bailey ..... H04R 1/105 381/380 |
| 2006/0177080 | A1 | 8/2006 | Smith |
| 2006/0188122 | A1 | 8/2006 | Smith |
| 2006/0215864 | A1 | 9/2006 | Espersen et al. |
| 2006/0262949 | A1 | 11/2006 | Cho et al. |
| 2007/0105598 | A1* | 5/2007 | Varming ..... H04M 1/05 455/569.1 |
| 2007/0116309 | A1 | 5/2007 | Smith |
| 2007/0183615 | A1 | 8/2007 | Wurfel |
| 2007/0254725 | A1 | 11/2007 | Smith |
| 2008/0085030 | A1 | 4/2008 | Smith |
| 2008/0159577 | A1 | 7/2008 | Smith |
| 2008/0181441 | A1 | 7/2008 | Smith |
| 2008/0247561 | A1 | 10/2008 | Smith |
| 2009/0092269 | A1 | 4/2009 | Nielsen et al. |
| 2009/0141923 | A1 | 6/2009 | Smith |
| 2009/0180654 | A1 | 7/2009 | Nielsen |
| 2009/0202094 | A1 | 8/2009 | Ammitzboll et al. |
| 2009/0226025 | A1 | 9/2009 | Howes et al. |
| 2009/0323993 | A1 | 12/2009 | Slemming et al. |
| 2010/0278364 | A1 | 11/2010 | Berg |
| 2012/0039500 | A1 | 2/2012 | Silvestri et al. |
| 2012/0321114 | A1 | 12/2012 | Ishibashi et al. |

FOREIGN PATENT DOCUMENTS

| | | | |
|---|---|---|---|
| DE | 3301927 | C1 | 6/1984 |
| DE | 29718483 | U1 | 2/1999 |
| DE | 102005044417 | A1 | 4/2007 |
| DE | 202011002165 | U1 | 5/2011 |
| EP | 0368125 | A2 | 5/1990 |
| EP | 0786241 | B1 | 7/2003 |
| EP | 1377113 | A2 | 1/2004 |
| EP | 1594340 | A1 | 11/2005 |
| EP | 2 434 777 | A1 | 3/2012 |
| EP | 3 016 406 | A1 | 5/2016 |
| GB | 2277422 | A | 10/1994 |
| GB | 2329787 | A | 3/1999 |
| JP | 55-104889 | | 7/1980 |
| JP | 2001333484 | A | 11/2001 |
| JP | 2004-274540 | A | 9/2004 |
| JP | 2005073144 | A | 3/2005 |
| JP | 2005-184579 | A | 7/2005 |
| JP | 10-2006-0084375 | | 7/2006 |
| PT | 2 177 045 | | 4/2010 |
| WO | WO 9429966 | A1 | 12/1994 |
| WO | WO 9530320 | A1 | 11/1995 |
| WO | WO 9623373 | A1 | 8/1996 |
| WO | WO 9623443 | A1 | 8/1996 |
| WO | WO 01/50813 | A2 | 7/2001 |
| WO | WO 01/50993 | A1 | 7/2001 |
| WO | WO 0150813 | A2 | 7/2001 |
| WO | WO 0150813 | A3 | 7/2001 |
| WO | WO 0245390 | A1 | 6/2002 |
| WO | WO 03034782 | A2 | 4/2003 |
| WO | WO 03075608 | A1 | 9/2003 |
| WO | WO 03096745 | A1 | 11/2003 |
| WO | WO 2004100508 | A1 | 11/2004 |
| WO | WO 2006/104981 | A2 | 10/2006 |
| WO | WO 2008/147215 | A1 | 12/2008 |
| WO | WO 2008147215 | A1 | 12/2008 |
| WO | WO 2009/030229 | A1 | 3/2009 |
| WO | WO 2010/031775 | A1 | 3/2010 |
| WO | WO 2010/040350 | A1 | 4/2010 |
| WO | WO 2010/040351 | A1 | 4/2010 |

OTHER PUBLICATIONS

Opposition dated Oct. 7, 2020, against European Patent EP 3 016 406 B1, Patentee: Freebit AS; Opponent: Bose Corporation, with Acknowledgement of receipt, 40 pages.

Priority application, NO 2007 2812, filed Jun. 1, 2007, 13 pages.

Communication of the Board of Appeal pursuant to Article 15(1) of the Rules of Procedure of the Boards of Appeal, Preliminary opinion of the Board of Appeal in Appeal No. T0384/15-3.5.03, Apr. 27, 2018, 16 pages.

Decision of Technical Board of Appeal 3.5.03 of Apr. 27, 2018, Case No. T 0384/15-3.5.03, 25 pages.

Minutes of the oral proceedings of Apr. 27, 2018, Appeal No. T0384/15-3.5.03, 5 pages.

Otoplastik, "Die individuelle Otoplastik zur Horgerateversorgung und als personlicher Gehorschutz im Larm", Ulrich Voogdt, 2005 (Extract), 321 pages.

Screen shot of "asono.com" web site of May 22, 2007 as stored in web archive "archive.org" (retrievable under URL https://web.archive.org/web/20070522080652/http://asono.com:80/), 1 page.

Screen shot of "asono.com" web site of May 22, 2007 as stored in web archive "archive.org" (retrievable under URL https://web.archive.org/web/20070423221413/http://asono.com:80/freebit) with frame of video item, 2 pages.

Screen shot of "asono.com" web site of May 22, 2007 as stored in web archive "archive.org" (retrievable under URL https://web.archive.org/web/20070325201344/http://media.asono.com:80/index.php?mID=38) with selected pictures, 2 pages.

Screen shot of "asono.com" web site of May 22, 2007 as stored in web archive "archive.org" (retrievable under URL https://web.archive.org/web/20070325225343/http://media.asono.com:80/index.php?mID=36) with selected pictures, 2 pages.

(56) References Cited

OTHER PUBLICATIONS

Jan Omdahl, "Innovative Bluetooth handsfree", Article discussing "Freebit H1" earphone published on Feb. 16, 2007, 6 pages.
Re-Amended Defence and Counterclaim pursuant to CPR 17.1(2)(a), UK Proceedings regarding family members of opposed patent (HP-2017-000033), Jan. 15, 2018, 3 pages.
E-mail communication of Freebit's CEO regarding sold devices and machine translation thereof submitted in UK proceedings, Dec. 2017, 5 pages.
Transcript of testimony under oath by R. Berg in UK proceedings (HP-2017-000033), *Bose* v *Freebit*, Proceedings—Day 4, Mar. 1, 2018, 67 pages.
Richard Steenfeldt Berg, Declaration under 37 C.F.R. § 1.132, US examination proceedings (U.S. Appl. No. 14/109,565), filed Jul. 11, 2014, 6 pages.
Excerpt of bulletin of the Norwegian Patent Office including design application No. 080734, Oct. 22, 2007, 4 pages.
An English machine translation of JP 2005-73144 (published Mar. 17, 2005), 18 pages.
Asono, "Freebit H1 User Guide," Jun. 30, 2007, English and Norwegian versions, 46 pages.
English translation of JP Notification of Reason for Refusal and JP Office Action Summary dated Sep. 3, 2013. 4 pages.
German Internet article of "Freebit H1 ," "Veroffenticht" Oct. 19, 2006, printed from http://www.golem.de/0610/48487.html, 4 pages.
International Preliminary Report on Patentability re PCT/N02008/000190, dated Dec. 1, 2009 with written opinion of the International Searching Authority dated Aug. 29, 2008, 54 pages.
Internet article in Dagbladet with pictures of "Asono Freebit H1 ," under the headline "Nyskapende blatann-handfri," dated Feb. 16, 2007, printed from http://www.dagbladet.no/dinside/2007/02116/492251.html, 3 pages.
Norwegian Internet article with pictures of "Freebit H1 ," dated Jan. 12, 2006, printed from www.mobilen.no/wip4/testdetail.epl?id=9008, 3 pages.
Printout from the Norwegian Patent Office online database with more specifications for N0312989, dated May 7, 2007, 31 pages.
Supplementary European Search Report for EP08766905 dated Oct. 15, 2010, 2 pages.
White, "Asono Freebit H1 Bluetooth Headset: Be Like Lt. Uhura," dated Oct. 18, 2006, printed from http://gizmodo.com/208374/asono-freebit-h1-bluetooth-headset-be-like-it-uhura. 2 pages.
Ziegler, "Asono's Freebit H1 Bluetooth Headset," dated Oct. 18, 2006, printed from http://mobile.engadget.com/2006/10/18/asonos-freebit-ha-bluetoothheadset, 3 pages.
Kapil et al., "Morphological Variation of ear for Individual Identification in Forensic Cases: A study of an Indian Population," Research Journal of Forensic Sciences, vol. 2, No. 1, Jan. 2014, pp. 1-8.
Kearney, "Variations of the External Ear in an Australian Population for the Purposes of Identification," thesis submitted to University of Adelaide, Oct. 27, 2003, 148 pages.
Algazi et al., "The CIPIC HRTF Database," IEEE Workshop on Applications of Signal Processing to Audio and Acoustics, Oct. 21-24, 2001, pp. W2001-1-W2001-4.
Burkhard et al., "Anthropometric manikin for acoustic research," Journal of the Acoustical Society of America, vol. 58, No. 1, Jul. 1975, pp. 214-222.
Declaration of Mr. Richard Steenfeldt Berg, dated Jul. 16, 2015, regarding European Patent No. 2177045, pp. 1-2.
Dobie, R.A. (2004) Medical-legal evaluation of hearing loss. 2nd Ed. San Diego, CA: Singular.
Yost, W. A. (1994) Fundamentals of hearing. 3rd Ed. New York: Academic Press.
Casali, J. G. (2010) Powered electronic augmentations in hearing protection technology circa 2010 including Active Noise Reduction, electronically-modulated sound transmission, and tactical communications devices: Review of design, testing, and research. International Journal of Acoustics and Vibration, 15(4), 168-186.
Casali, J. G., Lancaster, J.A., and Grinker, S. (2006) Do earphones for music reproduction provide hearing protection? Spectrum, vol. 23, Supplement 1, p. 20, and Proceedings (on CD) of the 31st Annual National Hearing Conservation Association Conference, Tampa, FL, Feb. 16-18, 2006.
Casaii, J. G. and Park, M. Y. (1990) Attenuation performance of four hearing protectors under dynamic movement and different user fitting conditions. Human Factors, 32(1), 9-25.
Casali, J. G., Ahroon, W. A., and Lancaster, J. (2009) A field investigation of hearing protection and hearing enhancement in one device: For soldiers whose ears and lives depend upon it. Noise and Health Journal, 11(42), 69-90.
Casali, J. G. (1992) Comfort: the "other" criterion for hearing protector design and selection. Proceedings of the 17th Annual National Hearing Conservation Association Conference (sponsored by the National Hearing Conservation Association and NIOSH), Cincinnati, Ohio, Apr. 1-4, 47-53. (Also in Spectrum, 9, Supplement 1, Winter 1992, 26).
Park, M. Y. and Casaii, J. G. (1991) An empirical study of comfort afforded by various hearing protection devices: laboratory versus field results. Applied Acoustics, 34, 151-179.
Casali, J. G., Lam, S. T., and Epps, B. W. (1987) Rating and ranking methods for hearing protector wearability. Sound and Vibration, 21(12), 10-18.
ANSI S12.6-1997 (R2008); ANSI S12.6-2016 Methods for the measurement of real-ear attenuation of hearing protectors. New York: American National Standards Institute, Inc.
Ear: Useful Notes on Human Ear. Samiksha, S. http://www.yourarticlelibrary.com/ear/ear-useful-notes-on- human-ear-13270-words/9691/ 69 pgs.
Hunter, A., et al. "Elements of Morphology: Standard terminology for the ear." Am J Med Genet Part A, 149A:40-60 (2009). 22 pgs.
The External Ear, 1d.1. Gray's Anatomy, Human Body > X. The Organs of the Senses and the Common Integument > The External Ear on http://www.theodora.com/anatomy/the_external_ear.html, 6 pgs.
The Math Forum. Ask Dr. Math, http://mathforum.org/library/drmath/view/53267.html, 4 pgs.
Boyd, A. The Power of three, #2533, The University of Houston's College of Engineering. http://www.uh.edu/engines/epi2533.htm, 4 pgs.
Roy F. Sullivan, Ph.D. Audiology Forum: Sullivan and Sullivan, Inc., Garden City, NY. http://www.rcsullivan.com/www/ears.htm—13.0, 1996.
Pirzanski, C., Issues in Earmold Fitting and Troubleshooting, Seminars in Hearing/vol. 24, No. 4, (2003) pp. 355-363, 10 pgs.
Roy F. Sullivan, Ph.D. The Auricle: Pinna/Concha, http://www.resullivan.com/www/pinna.htm; 1996, 4 pgs.
Declaration of Dr. John G. Casali, Trial No. IPR2017-00129, 211 pgs.

* cited by examiner

EARPIECE

CROSS-REFERENCE TO RELATED APPLICATIONS

This application is a continuation of U.S. application Ser. No. 16/519,943 filed Jul. 23, 2019, which is a divisional of U.S. application Ser. No. 16/003,928 filed on Jun. 8, 2018, which is a continuation of U.S. application Ser. No. 14/633,813 filed Feb. 27, 2015, which is a continuation of U.S. application Ser. No. 14/109,565 filed on Dec. 17, 2013 (now U.S. Pat. No. 8,976,995), which is a continuation of Ser. No. 12/600,795 filed on May 7, 2010 (Now U.S. Pat. No. 8,630,436), which is the National Phase of International Application No. PCT/NO2008/000190 filed on May 30, 2008, which claims priority under 35 U.S.C. § 119(a) to Norwegian Patent Application No. 20072812 filed on Jun. 1, 2007. The contents of all of these applications are hereby expressly incorporated by reference as fully set forth herein, in their entirety.

BACKGROUND OF THE INVENTION

Field of the Invention

The present invention regards a device for removable attachment to the ear.

Discussion of the Related Art

Microphone/earpiece combinations, wireless or attached by wire, to telephones, music systems, switchboards etc. are well known. Such known devices, however, frequently use a bow for the earpieces and a microphone attached to said bow. Such devices are not well suited for use with mobile apparatuses since the device should have a form that makes it easy to stow it in a pocket, bag or the like when not in use.

From the prior art one should refer to U.S. Pat. Nos. 6,122,388 and 5,659,156. These are earmold devices where a plug is brought into the ear canal and are typically used in hearing devices. These are not suited for mass production since each has to be adapted to each user for the stable positioning and comfortable use. This is particularly due to the opening in the ear that the ear plug is brought into differs from person to person. The outer part of the ear also differs from person to person yet these differences are not so great. Thus, using the outer shape of the ear for attachment of an ear unit only 2 or 3 different sizes will accomplish said differences.

Also an ear plug will block the ear canal and appear uncomfortable to a user. Moreover the natural production of ear wax will not escape, thus necessitating flushing of the ear at regular intervals.

References should also be made to U.S. Pat. No. 5,943,627 regarding an ear piece with built in microphone. Ear pieces for walkmen and the like are known, using the outer part of the ear for attachment, yet these have a circular shape and exploit only the lower part of the outer cavity of an ear for attachment and small differences in the size of the ear will cause said ear pieces not to fit particularly well.

References should also be made to a German utility patent DE 29718483 U1 where an inner clamp forces hoops outwardly towards the inner parts of the ear cavity in order to secure an attachment. The disadvantage is the constant outward pressure being exerted which over time can lead to discomfort.

Further references should be made to WO 02/45390, related to Norwegian patent NO 312 989 belonging to the applicant where a comfortable attachment is achieved by a combination of an ear unit formed as a large C placed under the tragus of the ear while further stability is assured by one part extending from the ear unit in the intertragic notch.

Also a reference should be made to WO 01/50813, an ear mould, filling in a substantial part of the ear mussel and the intertragic notch.

Next a reference should be made to WO 2004/100508, an ear unit using pads, where one of the support pads of is positioned between the Tragus and the Antitragus.

Finally, references should also be made to the Norwegian patent NO 312 909.

Also a reference should be made to US 2005/0008180 regarding a generally symmetric earpiece for use in either ear and made from a resilient material.

OBJECTIVE OF THE INVENTION

Based on the prior art the object of the invention is to avoid these disadvantages and limitation and simultaneously provide a further improvement in stability and comfortable attachment of an ear unit with the possibility of further functionality.

SUMMARY OF THE INVENTION

This is provided by a device according to the present invention. Further features of the invention are disclosed by the remaining dependent claims.

The shape of the ear unit keeps the ear canal to a certain degree open towards the outer environment for improved comfort when compared to a unit that closes or blocks the ear canal.

BRIEF DESCRIPTION OF THE DRAWINGS

Where is embodiments of the invention will be disclosed with references to the drawings, where.

DETAILED DESCRIPTION OF THE INVENTION

Figure 1:
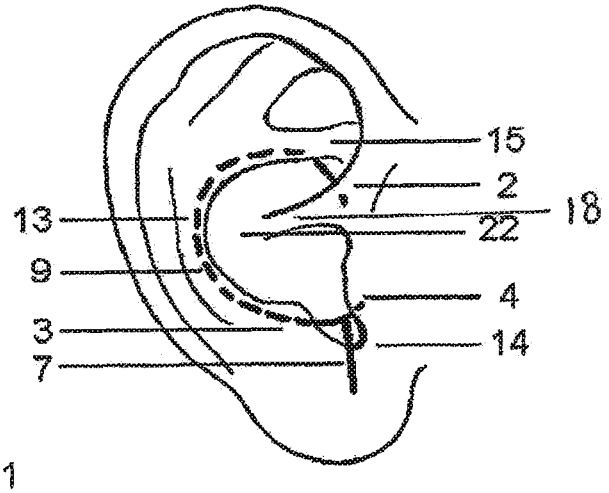
FIG. 1 shows schematically an ear with a curve along with a part extending down.

FIG. 1 shows schematically an ear with a decremental curve 1 inserted. As shown by the figure, the ear has an antihelix 13, a crus of helix 18, a tragus 4, an antitragus 3, an intertragic notch 14 and a concha 22 surrounded by the antihelix 13. The outer periphery of the ear unit is held in the ear by the outer parts of the ear such that the lower part of the antihelix 13, antitragus 3 and tragus 4 of the ear and part extending downwards 7, but intertragic notch 14. Parts of the curve is positioned inside the antihelix 13 when viewed from the outside of the ear where said parts therefore are not visible.

By the present invention, a larger part of the outer ear is utilized, thus achieving high stability while providing more comfort to the user than the previously known solutions. The present invention also utilizes the upper part of the antihelix 13 and the cavity covered by the lower node 15 of the antihelix and the flap 2 covering said cavity by the outer part of the ear adjacent to the head.

Figure 2:
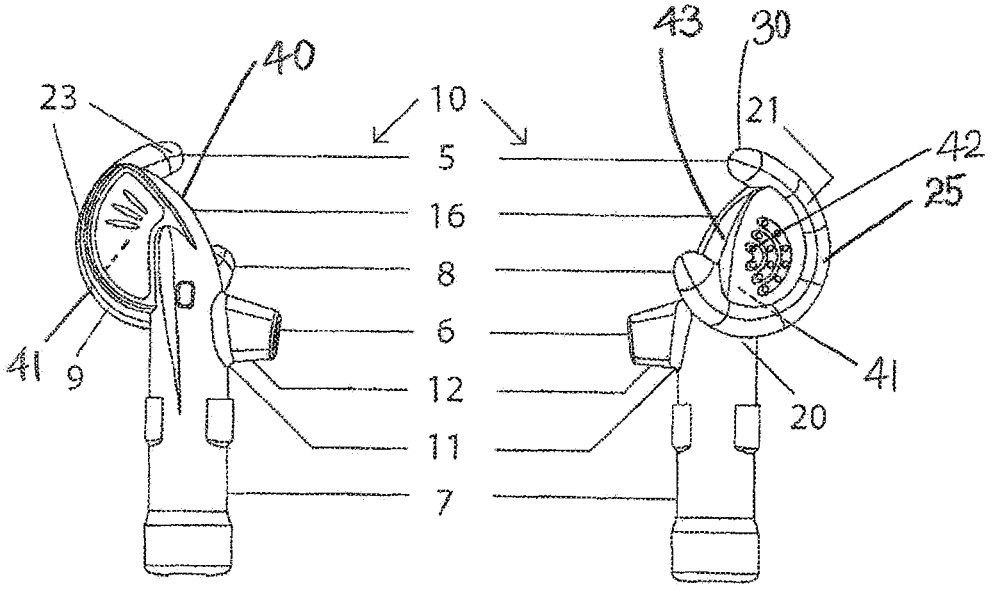
FIG. 2 shows an ear unit according to the present invention along with a microphone device.

The ear unit 10 according to the present invention is shown schematically in FIG. 2, with a microphone 6 and optionally a microphone rod 12 connected to the ear unit 10 at the junction point 11. Said microphone rod comprises the connection between the microphone 6 and the transmitter/receiver arranged in the ear unit 10. The power supply for the transmitter/receiver can optionally be arranged in the ear unit, for instance in the lower part 7 of the ear unit 10 for instance in the form of a rechargeable battery, for instance a miniature penlight cell that by virtue of its shape and weight leads to a low centre of gravity relative to the rotational axis formed at the landing point in a lower part of the ear cavity (by the intertragic notch 14). This helps increase the dynamic stability of ear unit 10 when the user is in motion. If the centre of gravity is too high and any centripetal forces caused by quick movements on the users behalf, it would cause the ear unit 10 to be pulled out of position from above. The antenna of the wireless part may be positioned for instance in the microphone rod. In addition, the ear unit 10 can be operated together with at least a second ear device to form a stereo effect.

Ear unit 10 comprises a decremental curve 9 of the outer part of the ear unit corresponding to the antihelix 13 with a surface shaped in such a way that the curve falls along the inner part of the antihelix 13 and is partly positioned under antitragus 3 of the ear. The optional lower part 7 extends from the curve while providing a guide and a weight for the correct positioning of the ear unit 10 by more or less lying in the intertragic notch 14 of the ear. The upper part of the curve projects into the cavity covered by the lower node 15 of the antihelix and underneath the flap 2 covering the lower part of said cavity. Investigations show that a contiguous line in the form of a decremental curve will fit in to the ear of nearly everyone.

By use of the ear unit 10, an opening is formed between the outer periphery 16 and the wall of the ear. This means that the ends 5 and 8 of the curve project out from the casing of the ear unit 10. Likewise, the part of the ear unit 10 comprising the hearing element is retracted slightly relative to the curve, ensuring that the hearing element does not abut the auditory canal directly, allowing the formation of an opening between the auditory canal and the surroundings.

The ear unit 10 is formed with a first surface 25 facing inwardly toward the concha 22 of the ear, a second, opposite surface 23 facing outwardly from the concha 22 of the ear, and an inner circumferential surface 26, opposite to the decremental curve 9 formed between the first surface 25 and the second surface 23. The first surface 25 has a curvature 21 in such a way that it follows along the inner surface of ear mussel or concha 22 when the ear unit 10 is positioned into the ear. This contact surface provides further stability since a larger area is placed against the ear mussel or concha, and thereby increased comfort.

The ear unit 10 is optionally arranged with an incision 20 so that it positions itself into the intertragic notch 14 when the ear unit 10 is positioned in the ear. This incision provides further stability and increased comfort.

FIG. 2 shows a typical embodiment of the invention with a part extending down 7 together with an incision 20 which ensures that said downward projecting part aligns with the intertragic notch 14 when the ear unit 10 is positioned into the ear.

Figure 3:
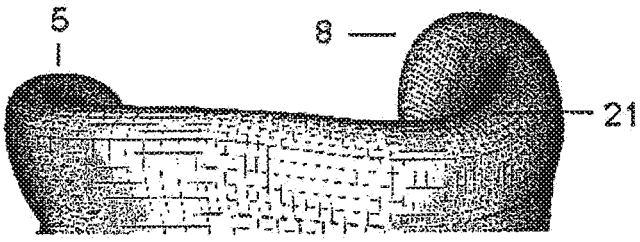
FIG. 3 shows an ear unit according to the present invention with a curvature enabling the ear unit to fit closely against the ear mussel.

FIG. 3 shows the ear piece 10 from the outside in such a way that the curvature 21 is clearly shown.

Figure 4:
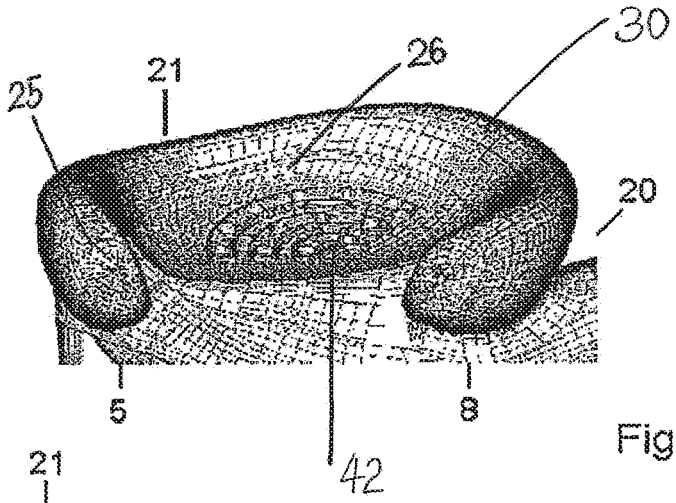
FIG. 4 shows the curvature of FIG. 3 from the opposite side and also an incision shaped in such a way that the incision is stabilized comfortably in the intertragic notch.
Figure 5:
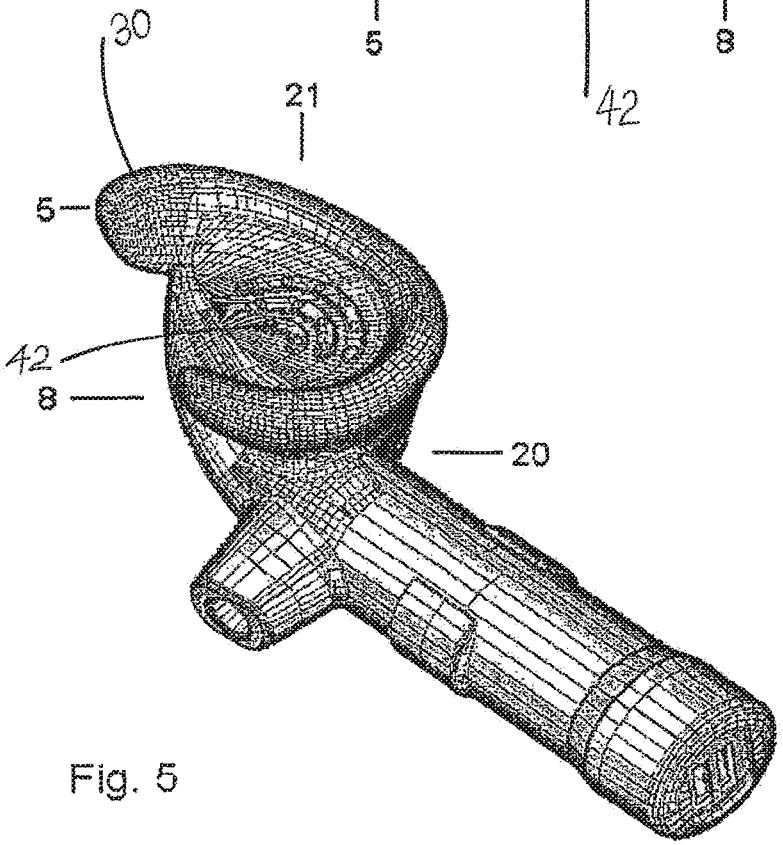
FIG. 5 shows an embodiment of the present invention comprising the curvature fitting closely against the ear mussel, the incision positioned stably into the intertragic notch and a part extending down from the ear unit.

FIGS. 4 and 5 show the ear piece from two different angles in such a way that the incision 20 is clearly shown.

What is claimed is:

1. A positioning structure for an earpiece, the positioning structure comprising:

a decremental curve structure having a main portion and a tip portion extending from the main portion, the decremental curve structure shaped to substantially fill the concha of a user when the earpiece is worn in the user's ear, the decremental curve structure having a first surface facing inwardly toward the concha and a second surface facing outwardly from the concha opposite to the first surface when the earpiece is worn in the ear; and an outer edge and an inner edge, each edge extending from the main portion to an end of the tip portion distant from the main portion, wherein the decremental curve structure corresponds to the inner part of the antihelix, and when the positioning structure is positioned in the ear, the first surface of the decremental curve structure is provided with a curvature conforming to an inner surface of the concha.

* * * * *